US009533854B2

(12) United States Patent
Beier et al.

(10) Patent No.: US 9,533,854 B2
(45) Date of Patent: Jan. 3, 2017

(54) METHOD FOR CREATING A FOLD PREPARATION PATTERN, COMPUTER FOR IMPLEMENTING THE METHOD AND SYSTEM HAVING THE COMPUTER

(75) Inventors: Bernard Beier, Ladenburg (DE); Karl-Heinz Filsinger, Wiesloch (DE); Stefan Temming, Luedinghausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 867 days.

(21) Appl. No.: 13/493,445

(22) Filed: Jun. 11, 2012

(65) Prior Publication Data

US 2012/0316664 A1 Dec. 13, 2012

Related U.S. Application Data

(60) Provisional application No. 61/498,215, filed on Jun. 17, 2011.

(30) Foreign Application Priority Data

Jun. 10, 2011 (DE) ..... 10 2011 103 982

(51) Int. Cl.
*B65H 45/28* (2006.01)

(52) U.S. Cl.
CPC ..... *B65H 45/28* (2013.01)

(58) Field of Classification Search
CPC ..... B65H 45/28; B65H 45/30; B65H 45/24; B65H 45/04; G05B 15/02; G06F 17/50
USPC ..... 700/97–99
See application file for complete search history.

(56) References Cited

U.S. PATENT DOCUMENTS

| | | | | |
|---|---|---|---|---|
| 5,797,320 | A | 8/1998 | Buschulte et al. | |
| 6,046,427 | A | 4/2000 | Richter et al. | |
| 6,056,682 | A | 5/2000 | Belanger et al. | |
| 6,584,899 | B1 | 7/2003 | Buschulte et al. | |
| 6,902,520 | B2 | 6/2005 | Beck et al. | |
| 7,346,408 | B2 * | 3/2008 | Van Bael | G06F 3/04845 700/182 |
| 2003/0226460 | A1 | 12/2003 | Kim | |

(Continued)

FOREIGN PATENT DOCUMENTS

| | | |
|---|---|---|
| DE | 327 613 | 10/1920 |
| DE | 44 42 411 A1 | 6/1996 |

(Continued)

OTHER PUBLICATIONS

German Patent and Trademark Office Search Report, Dated Jan. 17, 2012.

*Primary Examiner* — Nathan L Laughlin
(74) *Attorney, Agent, or Firm* — Laurence A. Greenberg; Werner H. Stemer; Ralph E. Locher

(57) ABSTRACT

A method for creating a fold preparation pattern includes supplying job-specific signature characteristics to a computer and determining job-specific cutting requirements by using general cutting requirements assigned to respective general signature characteristics in the computer and using the job-specific signature characteristics. The computer accesses a database that contains cutting, trimming, and clipping patterns and compiles job-specific fold preparation patterns in accordance with the job-specific cutting requirements. A computer for implementing the method and a system having the computer are also provided.

12 Claims, 4 Drawing Sheets

(56) References Cited

U.S. PATENT DOCUMENTS

| | | | | |
|---|---|---|---|---|
| 2005/0215409 | A1* | 9/2005 | Abramson et al. | 493/476 |
| 2007/0019224 | A1* | 1/2007 | Okada et al. | 358/1.13 |
| 2008/0277858 | A1* | 11/2008 | Shichijo | B65H 29/12 270/12 |
| 2011/0149337 | A1* | 6/2011 | Goetz et al. | 358/1.15 |

FOREIGN PATENT DOCUMENTS

| | | | |
|---|---|---|---|
| DE | 195 37 467 | C1 | 2/1997 |
| DE | 198 58 330 | A1 | 6/1999 |
| DE | 10 2008 030 457 | A1 | 12/2009 |
| EP | 1 475 334 | A1 | 11/2004 |
| WO | 9737837 | A1 | 10/1997 |

* cited by examiner

FIG. 1
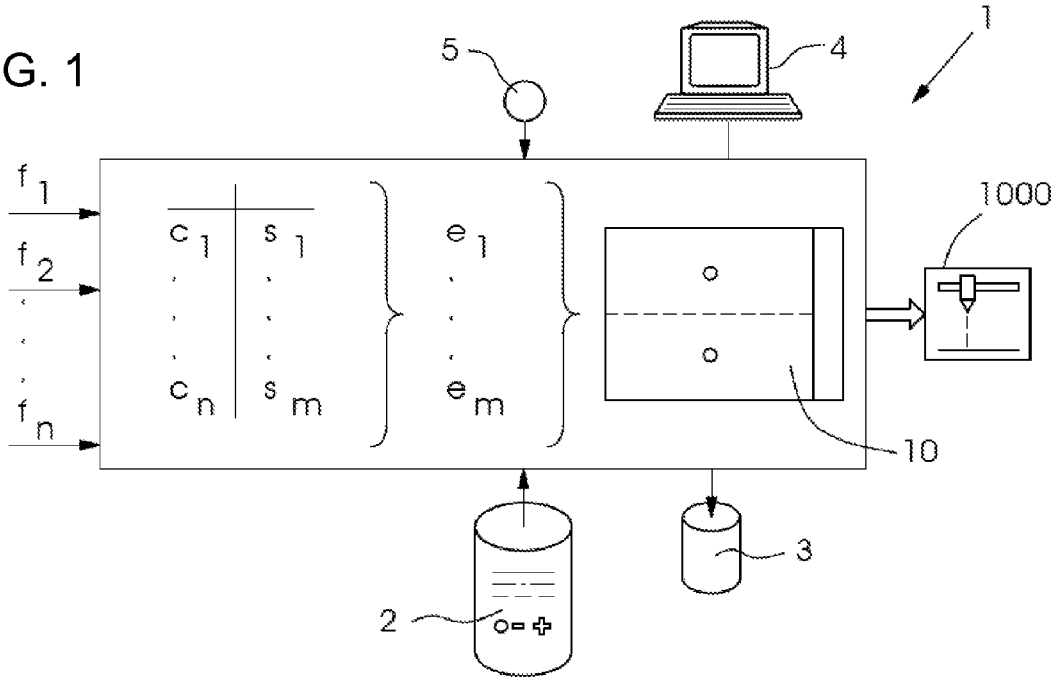
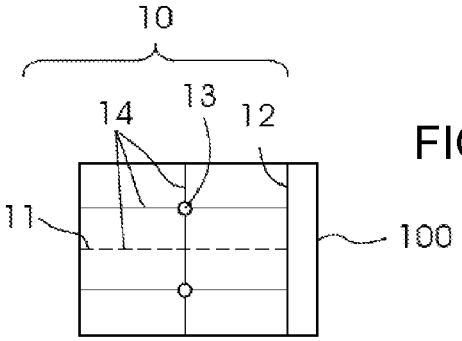
FIG. 2A
FIG. 2B
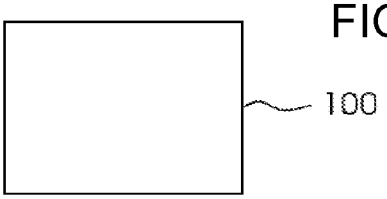

METHOD FOR CREATING A FOLD PREPARATION PATTERN, COMPUTER FOR IMPLEMENTING THE METHOD AND SYSTEM HAVING THE COMPUTER

CROSS-REFERENCE TO RELATED APPLICATION

This application claims the priority, under 35 U.S.C. §119, of German Patent Application DE 10 2011 103 982.5, filed Jun. 10, 2011 and the priority, under 35 U.S.C. §119(e), of U.S. Provisional Patent Application No. 61/498,215, filed Jun. 17, 2011; the prior applications are herewith incorporated by reference in their entirety.

BACKGROUND OF THE INVENTION

Field of the Invention

The invention relates to a method for creating a fold preparation pattern assigning cutting, trimming and/or clipping patterns to a signature in accurate positions. The invention also relates to a computer for implementing the method and to a system including a computer and a folder.

European Patent Application EP 1 475 334 A1, corresponding to U.S. Pat. No. 6,902,520, discloses a folder with a pair of knife shafts. The knife shafts are parallel to each other and are supported between two spaced-apart side walls of the folding machine. In order to be able to cut, perforate, crimp, crease, groove or press folded sheets of paper in a direction perpendicular to a fold line, i.e. in the direction of sheet travel, knife shaft pairs are provided upstream and/or downstream of the folding rollers in a folding unit. In the following, the phrases "to crease" and "to groove" are used synonymously, indicating a weakening of the sheet stock by removing material to reduce the cross-section. In general, the knife shafts are knife shaft pairs with one knife shaft equipped with tools and the other knife shaft equipped with counterpressure tools. The tools are mounted on tool holders that are slidable onto the knife shafts.

Such a preparation of sheets to be folded is necessary to cause the material to weaken at the desired positions of the folds and thus to ensure that the folds are actually created at the desired position. Otherwise, position deviations may occur, especially if relatively thick products are being produced. Such position deviations would have an adverse effect on product quality.

A disadvantage of using knife shafts is that they are difficult to adjust into their correct positions. A job change may even require the knife shafts to be dismounted from the folding machines to be able to slide additional knife holders onto the knife shafts.

Another disadvantage is that knife shafts located upstream of a buckle folding unit are incapable of implementing fold preparation operations for the folds to be created in that buckle folding unit. That is due to the fact that the knives of the knife shafts are only capable of creating cutting lines, perforation lines, or crease lines in the direction of travel, whereas the folds are perpendicular to the direction of travel. As a consequence, the known knife shafts can only carry out fold preparation operations for folds to be created in a second buckle folding unit if that second buckle folding unit is disposed at a 90° angle relative to the first buckle folding unit.

German Patent DE 44 42 411 B4, corresponding to U.S. Pat. Nos. 5,797,320 and 6,584,899, discloses providing a laser unit for treating, namely cutting, perforating or creasing sheets as they are transported through a printing press, in particular immediately upstream of the delivery. Known lasers for processing paper operate in the infrared (IR) range, as specified, for example, in German Patent Application DE 10 2008 030 457 A1. German Patent Application DE 198 58 330 A1, corresponding to U.S. Pat. No. 6,056,682, discloses a device for severing a web of material into individual sheets. The severing device, which may be a laser light source, is disposed on a sled, which is moved in the direction of travel and perpendicular to the direction of travel on a cam. The speed component in the direction of travel corresponds to the traveling speed of the printing stock. Thus, a cut at a right angle to the edges of the web is created. German Patent DE-PS 327 613 discloses punching or cutting out small cutouts prior to folding at points in sheets where folds intersect to enhance the quality of the folds.

SUMMARY OF THE INVENTION

It is accordingly an object of the invention to provide a method for creating a fold preparation pattern, a computer on which the method for creating a fold preparation pattern can be run and a system having the computer and a folding machine and allowing easier adjustment of the fold preparation pattern when changes are made to the folding machine, which overcome or at least reduce the hereinaforementioned disadvantages of the heretofore-known methods, computers and systems of this general type and which considerably reduce the demands on a machine operator.

With the foregoing and other objects in view there is provided, in accordance with the invention, a method for creating a job-specific fold preparation pattern assigning cutting, trimming and/or clipping patterns in accurate positions to a signature. (In this context, a cutting pattern refers to a cut made into the sheet, a trimming pattern to a portion that is cut off, i.e. actually removed from the sheet). In accordance with the method, job-specific signature characteristics are fed to a computer and job-specific cutting requirements are determined. For this purpose, general cutting requirements are associated with general signature characteristics in the computer. Once the job-specific cutting requirements are determined, the computer accesses a database in which cutting, trimming and clipping patterns are stored. In accordance with the job-specific cutting requirements, the computer selects cutting, trimming and clipping patters, assigns them to a specific position on the signature, and thus compiles job-specific fold preparation patterns.

In accordance with another mode of the invention, it is particularly advantageous if the cutting and/or trimming patterns include cutting lines, crease lines and perforation lines.

In accordance with a further mode of the invention, it is particularly advantageous if the clipping patterns include circles and/or ovals and/or polygons and/or crosses.

In accordance with an added advantageous mode of the method of the invention, a perforation line is formed of a plurality of perforation points and the position of the perforation points on the perforation line is unevenly distributed through the use of an algorithm.

In accordance with an additional particularly advantageous and thus preferred mode of the method of the invention, the job-specific signature characteristics include the sheet stock, initial format, target format (once the printed sheet has been trimmed), division, grammage, thickness and/or fold pattern (i.e. the fold diagram including the positions of the fold lines) of the signature.

In accordance with yet another advantageous mode of the invention, the fold preparation pattern is modifiable by inputs at an interface connected to the computer. This enables a machine operator to make corrections to the fold preparation pattern and to use his or her own experience in the creation of the fold preparation pattern.

In accordance with yet a further advantageous mode of the invention, the fold preparation pattern is fed to a fold preparation device that applies the fold preparation pattern by carrying out cutting, creasing, perforating and/or clipping operations on a respective signature for the purpose of preparing the signature. This fold preparation device may, for instance, include a laser aggregate or assembly for processing the sheet.

In accordance with yet an added advantageous mode of the invention, the fold preparation pattern is stored in a data memory for repeat jobs.

With the objects of the invention in view, there is also provided a computer for implementing the method described above for creating a fold preparation pattern. This computer may be integrated into a fold preparation device or into a processing machine. Alternatively, the computer may be a stand-alone device that is exclusively used to create the fold preparation pattern. Software that runs on such a stand-alone computer and into which the method described above is integratable is offered by the Applicant Heidelberger Druckmaschinen A. G. of Heidelberg, Germany, under the trade name "Compufold."

With the objects of the invention in view, there is concomitantly provided a system, comprising a computer as described above and a folding machine that includes a control unit, positionable guide elements and/or stops for sheet-guiding purposes (e.g. an alignment bar, buckle stops). The computer and the control unit have a data link or are constructed to be integrated. Position changes of the guide elements and/or of the stops are communicated to the computer by the control unit of the folding machine and are used to adapt the fold preparation pattern. In other words, the position of the cutting, trimming and clipping patterns is adapted as a function of the position change of the guide elements and/or stops of the folding machine.

Other features which are considered as characteristic for the invention are set forth in the appended claims.

Although the invention is illustrated and described herein as embodied in a method for creating a fold preparation pattern, a computer for implementing the method and a system having the computer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a diagrammatic and schematic illustration of a computer for implementing a method of the invention;

FIGS. 2A and 2B are plan views illustrating a fold preparation pattern and a signature;

DETAILED DESCRIPTION OF THE INVENTION

Figure 3A:
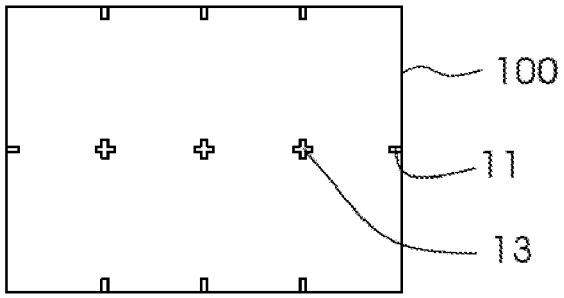
FIGS. 3A to 3G are plan views illustrating various fold preparation patterns.

Referring now to the figures of the drawings in detail and first, particularly, to FIG. 1 thereof, there is seen a computer 1 for creating a fold preparation pattern 10. The computer 1 is supplied with job-specific signature characteristics $f_1$ to $f_n$. These characteristics may be input by using an interface 4 or they may be transmitted to the computer 1 by using a data link. The job-specific signature characteristics $f_1$ to $f_n$ may be provided by a job management system such as "Prinect Postpress Manager" marketed by the Applicant, Heidelberger Druckmaschinen A. G. of Heidelberg, Germany. In the computer 1, general signature characteristics $C_1$ to $C_n$ are associated with general cutting requirements $S_1$ to $S_m$. Using these rules of association and based on the job-specific signature characteristics $f_1$ to $f_n$, the computer determines job-specific cutting requirements $e_1$ to $e_m$. A database 2 of the computer 1 stores cutting, trimming and clipping patterns. Cutting and trimming patterns include cutting lines, crease lines and perforation lines of different length and width. Different degrees of weakening of the stock are stored for the crease lines. The clipping patterns include circles, ovals, polygons and crosses. For each pattern, the database also contains information pertaining to the type of cutting requirements that the respective pattern meets. In a subsequent step, based on the job-specific cutting requirements $e_1$ to $e_m$, the computer selects two patterns from the database that meet the requirements and combines them to form a fold preparation pattern 10. This fold preparation pattern 10 may be displayed to the machine operator on display devices of the interface 4. The operator then has a chance to modify the suggested fold preparation pattern by using input devices of the interface 4. The fold preparation pattern 10 that has been created and potentially modified in this way may be stored in a memory 3. The fold preparation pattern 10 may likewise be supplied to a fold preparation device 1000 that implements the pattern by creating cuts, trimmings, perforations, clippings and creases in a respective signature to prepare it for a subsequent folding operation.

FIG. 2B illustrates an example of a signature 100. FIG. 2A illustrates an example of a fold preparation pattern 10 created by the computer 1 for this signature 100. In the illustrated example, the fold preparation pattern 10 includes a trimming line 12, a perforation line 11 and two holes as clippings 13. The trimming line 12 is in a position in which a fold preparation device 1000 is to place a trim. The perforation line 11 is in a position in which the fold preparation device 1000 is subsequently to create a perforation to ensure accurate positioning of a fold. The fold preparation pattern 10 envisages clippings 13 at intersections of further fold lines 14, where the fold preparation device 1000 subsequently is to punch or otherwise create holes.

Figure 3B:
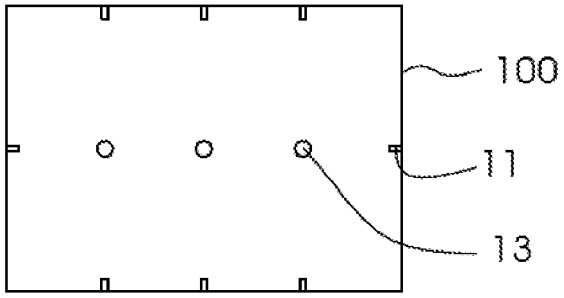
Figure 3C:
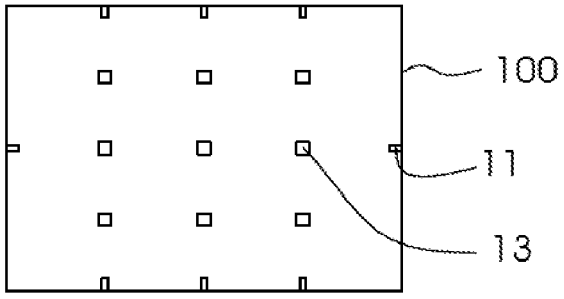
Figure 3D:
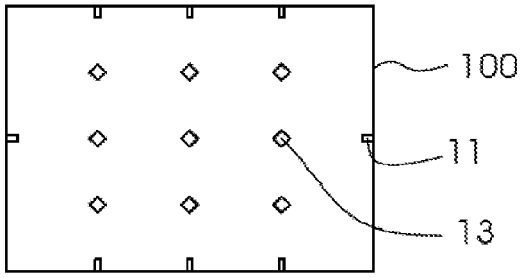
Figure 3E:
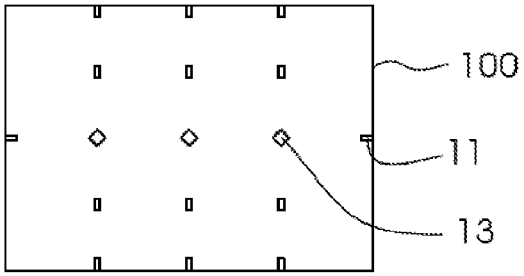
Figure 3F:
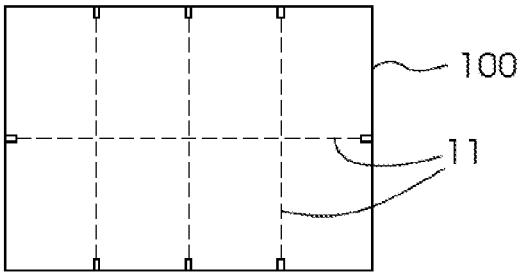
Figure 3G:
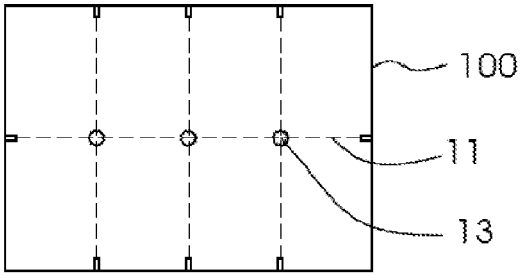

FIGS. 3A to 3G illustrate further examples of fold preparation patterns 10 assigned to a sheet 100. What these patterns have in common is that they include a plurality of cutting patterns 11 that represent short partial cuts. Each of these short partial cuts is located at the edge of the signature 100 in a position in which folds are to be created. Such partial cuts enhance the quality of the folds to a considerable extent because the sheet stock is easier to buckle when a respective fold is being made. FIGS. 3A, 3B, 3C, 3D, 3E and 3G additionally illustrate clipping patterns 13 that are positioned at the intersections of fold lines. In FIG. 3A, the clipping patterns take the form of a cross. In FIG. 3B, they are circles, in FIG. 3C squares, in FIG. 3D diamonds and in FIG. 3E diamonds and rectangles. In the fold preparation pattern 10 of FIG. 3E, different clipping patterns 13 are combined. In FIGS. 3F and 3G, cutting patterns 11 are envisaged in the position of fold lines. These cutting patterns 11 may either be crease lines or perforation lines. In addition to these clipping patterns 11, the fold preparation pattern 10 of FIG. 3G envisages clipping patterns 13 at the intersections of the fold lines 14.

Figure 4:
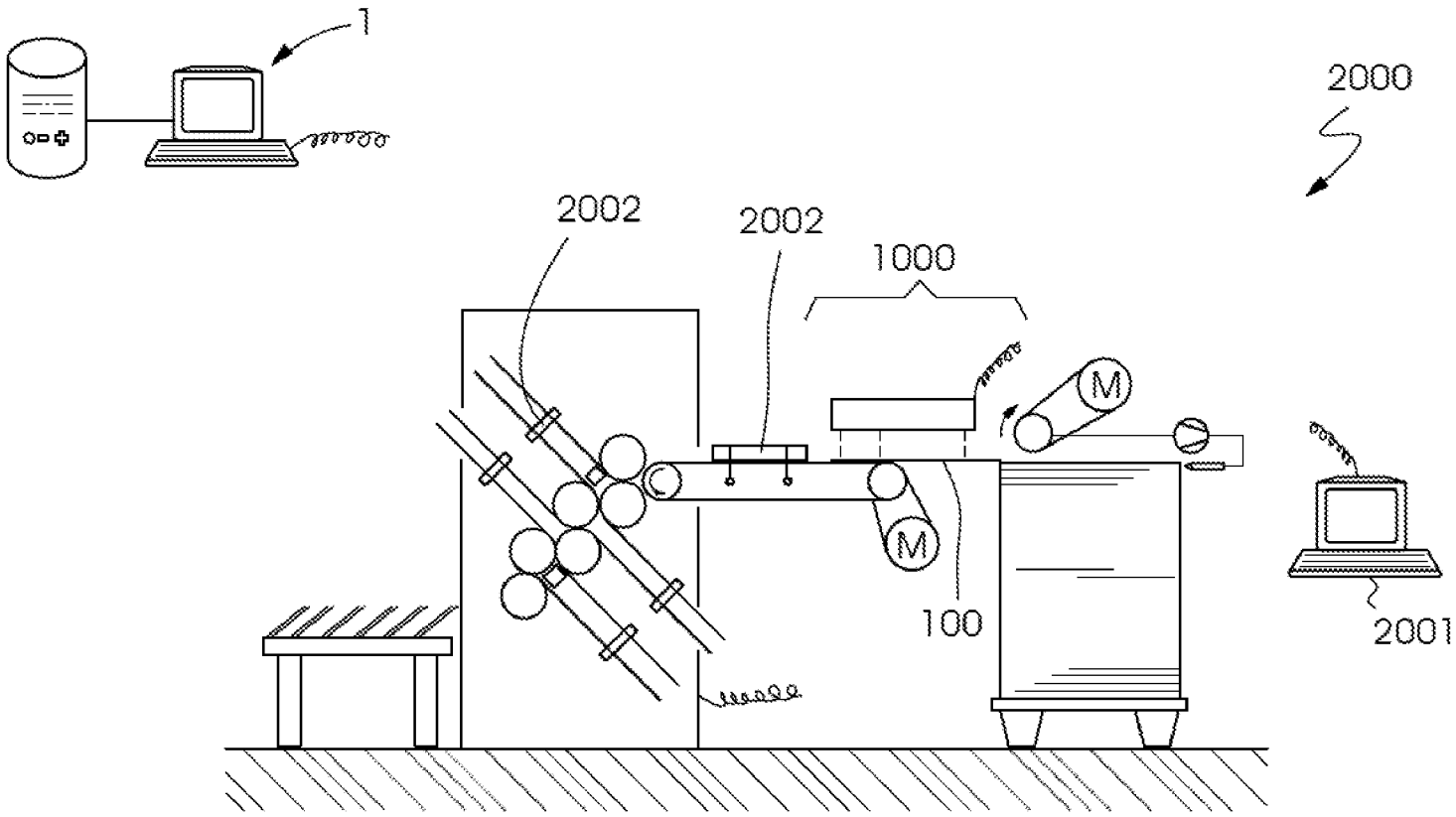
FIG. 4 is a longitudinal-sectional view illustrating a system having a folding machine, a fold preparation device and a computer.

FIG. 4 illustrates a system formed of a folding machine 2000, a fold preparation device 1000, such as a trimming device with a laser unit, and a computer 1 as described above. The computer 1 provides a fold preparation pattern 10, which is fed to the fold preparation device 1000 using data links. The fold preparation device 1000 may be integrated into the folding machine 2000 as illustrated in the present example, or it may be a separate module. The folding machine 2000 includes a machine control 2001, which is likewise connected to the computer 1 by a data link. If guide elements or stops 2002 of the folding machine 2000 are adjusted and moved out of their initial target positions in order to further improve the accuracy of the fold, the control 2001 signals the position change to the computer 1, which automatically adapts the fold preparation pattern 10. Alternatively, a query may be made to the machine operator as to whether or not an adaptation is to be made. The adapted pattern 10 will then be supplied to the fold preparation device 1000.

The invention claimed is:

1. A method for creating a digital fold preparation pattern, the method comprising the following steps:

assigning at least one of cutting, trimming or clipping patterns in accurate positions to a plurality of paper sheet signatures defining a thickness of a product, by:

supplying job-specific paper sheet signature characteristics to a computer, including at least grammage and fold pattern of the paper sheet signature;

determining job-specific cutting requirements using general cutting requirements assigned to respective general paper sheet signature characteristics in the computer and using the job-specific paper sheet signature characteristics; and using the computer to access a database containing cutting, trimming and clipping patterns and compile a job-specific digital fold preparation pattern from the cutting, trimming and clipping patterns in accordance with the job-specific cutting requirements for supplying the digital fold preparation pattern to a fold preparation device to prepare a paper sheet signature for folding the plurality of paper sheet signatures defining the thickness of the product in a folding machine.

2. The method for creating a fold preparation pattern according to claim 1, wherein at least one of the cutting patterns or trimming patterns include cutting lines, crease lines and perforation lines.

3. The method for creating a fold preparation pattern according to claim 2, which further comprises forming a perforation line of a plurality of perforation points having a position on the perforation line being unevenly distributed using an algorithm.

4. The method for creating a fold preparation pattern according to claim 1, wherein the clipping patterns include at least one of circles, ovals, polygons or crosses.

5. The method for creating a fold preparation pattern according to claim 1, wherein the job-specific signature characteristics further include at least one of type of stock, format, target format, partition or thickness.

6. The method for creating a fold preparation pattern according to claim 1, which further comprises modifying the fold preparation pattern with inputs into an interface connected to the computer.

7. The method for creating a fold preparation pattern according to claim 1, which further comprises supplying the fold preparation pattern to a fold preparation device.

8. The method for creating a fold preparation pattern according to claim 1, which further comprises supplying the fold preparation pattern to a fold preparation device and storing the fold preparation pattern for repeat orders.

9. The method for creating a fold preparation pattern according to claim 1, which further comprises storing the fold preparation pattern for repeat orders.

10. A computer implementing the method for creating a fold preparation pattern according to claim 1.

11. The method for creating a fold preparation pattern according to claim 1, which further comprises enabling a machine operator to make any necessary corrections to the fold preparation pattern in a separate step.

12. A system, comprising:

a computer implementing the method for creating a fold preparation pattern according to claim 1;

a folding machine for folding the plurality of paper sheet signatures defining the thickness of the product, the folding machine having a control unit, positionable guide elements and stops for guiding sheets;

a data link interconnecting said computer and said control unit; and said control unit communicating position changes of said guide elements and said stops to said computer for adapting the fold preparation pattern.

* * * * *